US011635246B2

(12) United States Patent
Wurm

(10) Patent No.: US 11,635,246 B2
(45) Date of Patent: Apr. 25, 2023

(54) METHOD FOR FREEZING A LIQUID

(71) Applicant: Single Use Support GmbH, Kufstein (AT)

(72) Inventor: Thomas Wurm, Stumm (AT)

(73) Assignee: SINGLE USE SUPPORT GMBH, Kufstein (AT)

( * ) Notice: Subject to any disclaimer, the term of this patent is extended or adjusted under 35 U.S.C. 154(b) by 156 days.

(21) Appl. No.: 16/822,250

(22) Filed: Mar. 18, 2020

(65) Prior Publication Data

US 2020/0217579 A1 Jul. 9, 2020

Related U.S. Application Data

(63) Continuation of application No. PCT/AT2018/060207, filed on Sep. 12, 2018.

(30) Foreign Application Priority Data

Sep. 19, 2017 (AT) ..... A 50788/2017

(51) Int. Cl.
*F25D 11/04* (2006.01)
*F25D 17/04* (2006.01)

(52) U.S. Cl.
CPC ..... *F25D 11/04* (2013.01); *F25D 17/04* (2013.01); *F25D 2201/126* (2013.01)

(58) Field of Classification Search
CPC . F25C 1/22; F25D 11/04; F25D 17/04; F25D 25/005; F25D 3/00; F25D 3/10; F25D 2201/126
See application file for complete search history.

(56) References Cited

U.S. PATENT DOCUMENTS 1,824,309 A 9/1931 Storer
2,633,006 A * 3/1953 Taylor ..... F25C 1/22 249/82
2,703,964 A 3/1955 Ashley
(Continued)

FOREIGN PATENT DOCUMENTS

CN 2058303 6/1990
CN 101932235 12/2010
(Continued)

OTHER PUBLICATIONS

An Jiaju et al., "Practical Fine Chemicals Dictionary (Second Edition)", China Light Industry Press, Sep. 2000, with concise statement of relevancy.

*Primary Examiner* — Elizabeth J Martin
*Assistant Examiner* — Samba Nmn Gaye
(74) *Attorney, Agent, or Firm* — Wenderoth, Lind & Ponack, L.L.P.

(57) ABSTRACT

A method for freezing a liquid located in a container, in particular a liquid drug, includes exposing the container to a cooling element such as cold gas in order to freeze the liquid. The cold gas preferably flows around the container, and/or the liquid is cooled in another way in order to freeze the liquid. The container is insulated at a surface of at least one first volume portion of the container, and the container is cooled nearly immediately at a surface of a second volume portion of the container by the cold gas such that the liquid freezes through later in the at least one first volume portion than in the second volume portion.

18 Claims, 7 Drawing Sheets

(56) References Cited

U.S. PATENT DOCUMENTS

| | | | | |
|---|---|---|---|---|
| 2,722,111 | A | 11/1955 | Taylor | |
| 2,775,096 | A | 12/1956 | Ashley | |
| 4,974,809 | A | 12/1990 | Lipke et al. | |
| 5,100,016 | A * | 3/1992 | Wischusen, III | B65D 5/248 229/103.11 |
| 8,177,123 | B2 | 5/2012 | Voute et al. | |
| 8,371,132 | B2 | 2/2013 | Cutting et al. | |
| 8,438,714 | B2 | 5/2013 | Mankame et al. | |
| 8,448,457 | B2 | 5/2013 | Cutting et al. | |
| 8,864,403 | B2 | 10/2014 | Mankame et al. | |
| 9,161,527 | B2 | 10/2015 | Cutting et al. | |
| 9,301,520 | B2 | 4/2016 | Cutting et al. | |
| 9,310,117 | B2 | 4/2016 | Schlessinger et al. | |
| 9,574,811 | B2 | 2/2017 | Papalia | |
| 9,777,955 | B2 | 10/2017 | Hardy et al. | |
| 9,933,113 | B2 | 4/2018 | Cutting et al. | |
| 10,088,106 | B2 | 10/2018 | Cutting et al. | |
| 10,408,521 | B2 | 9/2019 | Hardy et al. | |
| 10,955,181 | B2 | 3/2021 | Hardy et al. | |
| 2004/0134203 | A1 * | 7/2004 | Voute | A23L 3/364 62/66 |
| 2009/0158755 | A1 * | 6/2009 | Cutting | F17C 3/085 62/66 |
| 2010/0072216 | A1 | 3/2010 | Voute et al. | |
| 2011/0120151 | A1 | 5/2011 | Cutting et al. | |
| 2011/0120667 | A1 | 5/2011 | Cutting et al. | |
| 2011/0194887 | A1 | 8/2011 | Mankame et al. | |
| 2011/0247349 | A1 | 10/2011 | Cutting et al. | |
| 2013/0223918 | A1 | 8/2013 | Mankame et al. | |
| 2014/0047851 | A1 | 2/2014 | Zhou et al. | |
| 2015/0107275 | A1 | 4/2015 | Papalia | |
| 2015/0122826 | A1 | 5/2015 | Schlessinger et al. | |
| 2016/0073626 | A1 | 3/2016 | Cutting et al. | |
| 2016/0195218 | A1 | 7/2016 | Cutting et al. | |
| 2016/0223243 | A1 | 8/2016 | Hardy et al. | |
| 2017/0038112 | A1 | 2/2017 | Papalia | |
| 2018/0073793 | A1 | 3/2018 | Hardy et al. | |
| 2020/0041189 | A1 | 2/2020 | Hardy et al. | |

FOREIGN PATENT DOCUMENTS

| | | |
|---|---|---|
| CN | 102146946 | 8/2011 |
| CN | 104081142 | 10/2014 |
| CN | 104719284 | 6/2015 |
| CN | 205133484 | 4/2016 |
| DE | 10 2007 049 278 | 4/2009 |
| KR | 10-2011-0023942 | 3/2011 |
| KR | 10-2016-0083931 | 7/2016 |
| WO | 88/08946 | 11/1988 |
| WO | 2009/086136 | 7/2009 |
| WO | 2012/135216 | 10/2012 |

* cited by examiner

METHOD FOR FREEZING A LIQUID

BACKGROUND OF THE INVENTION

The present invention concerns a method of freezing a liquid in a container, in particular a liquid drug, a method of freezing liquids in a plurality of containers and an arrangement which includes a container filled with a liquid, in particular a liquid drug.

The state of the art is briefly outlined hereinafter using the example of a liquid drug. In the production of the drug firstly relatively large amounts are produced, which far exceed individual dosages for patients. The drug therefore has to be transported from the manufacturing facility to that location at which it is filled into smaller volumes. As that large amount of drug involves a considerable value and as contamination of the drug must naturally be avoided under any circumstances relatively complicated and laborious measures are taken for that transport operation.

One possibility is to proceed as follows: firstly the liquid drug is filled into a flexible plastic container which in the normal situation is disposed of after transport, that is to say it is not re-used (so-called single use bag of a volume of 50 ml to 50 l). Thereafter the flexible (inner) container is arranged in a generally rigid outer container. That outer container is intended to provide as good protection from mechanical influences as possible. The arrangement of the inner container which contains the liquid and the outer container is then deep-frozen so that the drug freezes.

Besides so-called plate freezers in which the container is firmly held between cooled plates, other types of cooling elements include circulating air freezers (or blast freezers), wherein circulating air is caused to flow around the containers to freeze the liquid. It is also possible to use static freezers, in which case a cold gas flow is not necessarily produced.

By virtue of the fact that the drug still consists of water for a large part and the water experiences an increase in volume upon freezing problems can arise in the above-described procedure in connection with circulating air freezers. In that case the liquid is frozen from the exterior, whereby there is a remaining bubble of liquid which has not yet frozen in the interior (in particular in containers of volumes of 1000 ml or more). Because in the freezing operation the liquid in the non-frozen remaining bubble expands the frozen edge layer is subjected to stresses. As the ice is brittle the outer bubble bursts, and that can cause the container to buckle and bulge out. In the worst-case scenario further mechanical damage occurs, both in the inner and also the outer container, as far as puncturing of the flexible inner container or even tearing thereof. It is clear that that is a disadvantage both for transport of the drug and also for thawing thereof at the destination. In the simplest case at any event suitable stacking of the containers encounters difficulty or is even prevented.

For a visual representation of the underlying problems attention is directed to FIGS. 1*a* to 1*c* and the related specific description.

SUMMARY OF THE INVENTION

The object of the invention is to prevent or at least reduce the above-described disadvantageous consequences when freezing the liquid drug.

That object is effected in that the container for freezing the liquid is exposed to a cooling element such as a cold gas, preferably having the cold gas flowing around same, and the container is insulated at a surface of at least a first volume portion of the container, and the container is cooled substantially directly by the cold gas at a surface of a second volume portion of the container, so that the liquid freezes therethrough in the at least one first volume portion later than in the second volume portion.

By means of the invention it is possible to avoid the liquid freezing in the at least one first volume portion before that is the case in the second volume portion, which could entail the liquid being enclosed in the second volume portion. The situation described in the opening part of this specification, whereby frozen liquid encloses non-frozen liquid, can have the result that upon freezing of the liquid which is still in a liquid state, the liquid which has already frozen is ruptured.

The method according to the invention can in principle be used in relation to all liquids, in particular liquid drugs and all liquids which occur in the manufacturing process for drugs, that is to say including in respect of primary products and the like.

It is to be noted that the method steps of the invention described herein do not have to be carried out in that time sequence. In actual fact in practice insulation of the at least one first volume portion of the container is frequently dealt with first, that not necessarily being required.

It is also possible by means of the invention to provide that the containers can always be well stacked, because the above-mentioned buckling out effects at the top side and the underside do not occur. The latter also prevents the visual aspect from being adversely affected.

Besides so-called plate freezers in which the container is held between cooled plates it is also possible in accordance with the invention to use so-called circulating air freezers (or blast freezers), wherein circulating air is caused to flow around the containers to freeze the liquid. It is also possible to use static freezers, in which a cold gas flow is not necessarily produced.

It can particularly preferable that the second volume portion is a center of the container and the at least one first volume portion extends from the center of the container to the edges of the container. It is thus possible in a particularly simple fashion to prevent the occurrence of a liquid core which upon freezing causes the outer layer which has already frozen to burst.

That however is not necessarily required. For example, the container could be almost completely insulated except for an edge region. Then firstly the edge region would freeze and the liquid would then progress in a uniform "freezing front" (that is to say without the inclusion of liquid which has not yet frozen), for example to an opposite edge.

Substantially cuboidal containers are practicable. That is particularly the case when they are relatively shallow. The term shallow cuboidal containers is used to denote for example containers whose height is less than a quarter of a width or a length of the container.

At least one insulation body can be used for insulating the surface of the at least one first volume portion. That represents a particularly simple configuration. Alternatively, it would be possible to construct the corresponding freezing apparatus in such a way that the cooling action at least at the beginning of the freezing process occurs only at a part of the surface of the container.

The insulation body can be substantially of a U-shaped cross-section (they can then also be referred to as "shells"), which is advantageous in particular when using cuboidal containers as the insulation body is then easy to fit and to a certain degree is held by itself to the container. That can even be to such an extent that the arrangement comprising the container and the insulation body can be easily carried at the insulation body.

It will be appreciated that more than one insulation body can be used. In the case of a cuboidal container with an insulation body which is preferably of a U-shaped profile it is preferably possible to use two insulation bodies which are laterally fitted on to the edge regions. That represents a particularly simple embodiment of the invention.

It is however not necessarily required for the insulation bodies to be fitted on to the container. It would also be possible for the insulation body to be integrated into the container.

The at least one insulation body can be of a thickness of between 1 cm and 30 cm, preferably between 2 cm and 20 cm and particularly preferably between 3 cm and 10 cm. In an embodiment the at least one insulation body is of a thickness of 4 cm.

The at least one insulation body can be of a material having a thermal conductivity of less than 0.5 W/mK, preferably less than 0.2 W/mK and particularly preferably less than 0.1 W/mK. Preferred materials are expanded or extruded hydrocarbon polymers.

The at least one insulation body can also be such that containers provided therewith are easy to stack. In particular the at least one insulation container can be adapted to accommodate a plurality of containers—preferably arranged in mutually superposed relationship.

Containers provided with corresponding insulation bodies can also be safer to stack because the insulation bodies have a higher static friction relative to each other than for example metal plates which can form top sides and undersides of the containers (anti-slip effect).

The container can preferably be an arrangement of a flexible inner container holding the liquid and a substantially rigid outer container. The surface of the outer container is understood as being the surface of a container of such a configuration. The insulation or the at least one insulation body can be arranged externally on the outer container or between the inner container and the outer container—the latter in particular when the insulation or the at least one insulation body is integrated into the container. In particular the outer container can be cuboidal.

It is possible to use between the inner container and the outer container a foam, by means of which an increase in volume of the liquid upon freezing is at least partially compensated. Such foams are generally not capable of compensating for a rupture of a frozen bubble, as is the subject-matter of the present invention. The "normal" expansion in volume of about 8% can certainly be accommodated with a suitable configuration of a suitable foam.

A preferred embodiment can be one in which the foam has decreasing elasticity with falling temperature below the freezing point. It can also be provided that the foam substantially hardens at a temperature between 0° C. to −30° C., preferably between −5° C. and −25° C. and particularly preferably between −10° C. and −20° C. Those measures can contribute to the flexible inner container being disposed in a precisely adapted "bed" in the outer container. All forces acting on the flexible inner container and the outer container are thereby received by relatively large surface areas. Damage due to clamping or the like is thereby further reduced.

In a particularly preferred configuration the foam is such that the hardening process is reversible. Upon the increase in temperature of the arrangement after transport therefore the elasticity of the foam is again available and thereby offers a certain protection from effects acting on the flexible inner container upon being removed from the outer container.

In a preferred configuration it can be provided that the outer container is lined with the foam in such a way that the inner container—together with any attachments—is completely surrounded by the foam when the inner container is arranged in the outer container. In that way not only the flexible inner container but also the attachments can be still better protected from damage. Quite particularly preferably however it is provided that there is direct contact between the inner container and the outer container at the top side and/or underside. The foam then encloses the inner container at the edges.

As attachments for such flexible inner containers are often of differing shapes because for example they comprise deformable tubes and the like a foam block in the outer container can be advantageous, which can accommodate the attachments (by deformation).

Inner containers can have to be transported, which have not been completely filled. In that case, it is possible to use an additional layer of foam, whereby in that case too a "bed" which fills up the volume of the outer container is provided for the flexible inner container.

The top side and/or the underside of the container can be respectively formed by a metal plate—that applies in particular to the outer container in a structure involving an inner and an outer container. A metal plate has on the one hand the advantage of increased stability (for example in comparison with a plastic plate) and on the other hand a good thermal conduction effect (or in the present case actually a cold conduction effect), which can accelerate freezing of the liquid.

In addition, a method of freezing liquids disposed in a plurality of containers that are frozen is also provide. In that case, the containers can preferably be arranged in mutually superposed relationship and can be disposed for freezing in a freezing apparatus.

An arrangement includes a container filled with a liquid, in particular a liquid drug, and at least one insulation body arranged at a surface at least of a first volume portion of the container, in particular for carrying out a method according to the invention, wherein a surface of a second volume portion of the container is insulation-free.

A freezing apparatus together with such an arrangement is provided, and a plurality of such arrangements can also be disposed in the freezing apparatus—preferably in mutually superposed relationship. The freezing apparatus can be adapted to freeze the liquid in the container or the liquids in the containers by a cooling element such as cold gas or by other means, in particular by causing cold gas to flow therearound.

A suitable freezing apparatus can also involve a refrigerating system in the form of a chamber in which the material to be frozen is exposed to cold air. The temperature of the cold air can be less than −10° C., preferably less than −25° C. and particularly preferably less than −50° C. This can involve for example blast freezers or static freezers.

In an arrangement of corresponding containers—in particular in mutually superposed relationship—it is possible to use at least one insulation body which can accommodate a plurality of containers.

BRIEF DESCRIPTION OF DRAWINGS

Further details and advantages of the invention will be apparent from the Figures and the related specific description. In the Figures.

DETAILED DESCRIPTION OF THE INVENTION

Figure 1A:
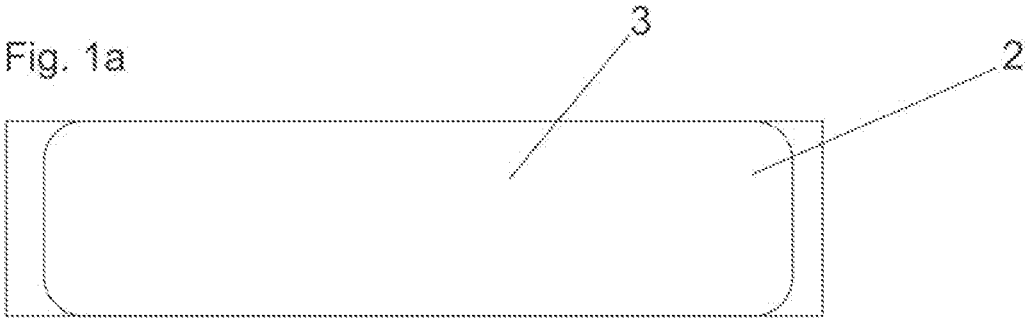
FIGS. 1*a* to 1*c* show steps in a method of freezing a liquid according to the state of the art.
Figure 1B:
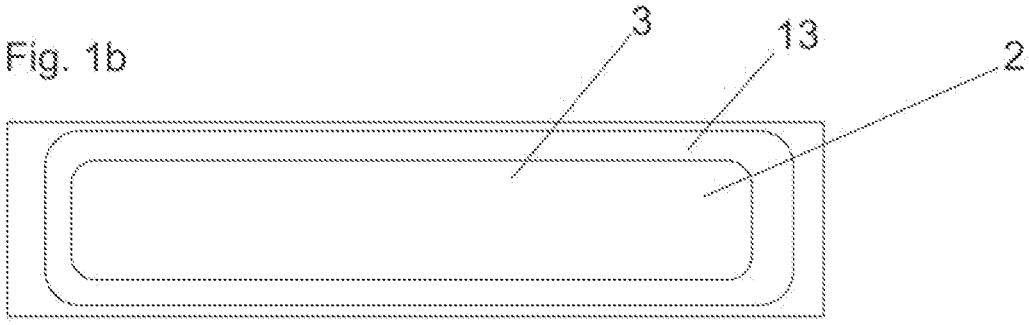
Figure 1C:
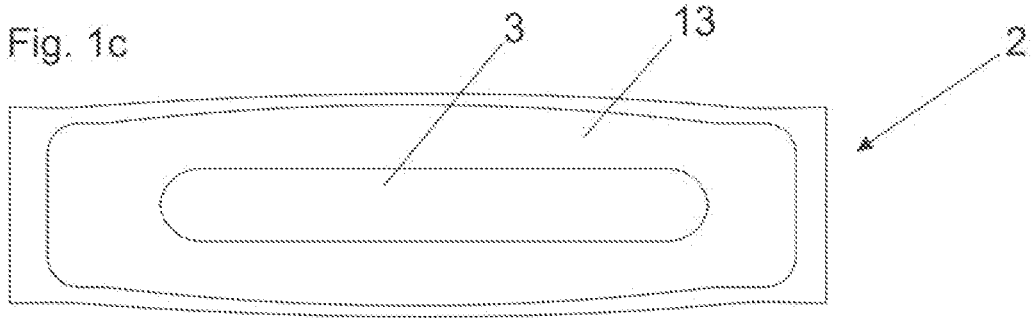

FIGS. 1*a* to 1*c* show a method according to the state of the art of freezing a liquid, in particular a drug. At the beginning the liquid 3 is arranged in the container 2. Cooling from the exterior causes a partial volume 13 of the liquid 3 to freeze, more specifically in such a way that the partial volume 13 encloses the volume of the liquid 3 which is still liquid, as is shown in FIG. 1*b* (therefore from edge layers). As that process progresses, the expansion in volume upon freezing of the part of the liquid that is not yet frozen leads to relatively great stresses in the partial volume 13 which is already frozen. Those stresses are firstly transmitted to the container 2 and secondly can result in rupture of the frozen partial volume 13. The invention seeks to avoid that effect which is shown in FIG. 1*c*.

FIGS. 2*a* to 2*d* show an embodiment according to the invention.

The arrangement 1 which is shown in FIGS. 2*a* to 2*d* is expanded in relation to the state of the art by the two U-shaped insulation bodies 4, those insulation bodies 4 being fitted over edge regions of the cuboidal container 2. As can be seen from FIG. 2*b* the insulation bodies prevent that partial volume 13 of the liquid 3, which freezes first, from enclosing that partial volume of the liquid 3, which is not yet frozen. Rather, a cooling element such as cooling gas forms two "freezing fronts" which meet from the upper and lower central region. Admittedly, here too, the increase in volume upon freezing of the liquid 3 takes place. In this case, however, that is no problem as the additional volume can be pushed out to the side. In other words, there is no enclosed region of liquid 3 which has not yet frozen, which could exert greater stresses on the partial volume 13 which has already frozen.

Figure 2A:
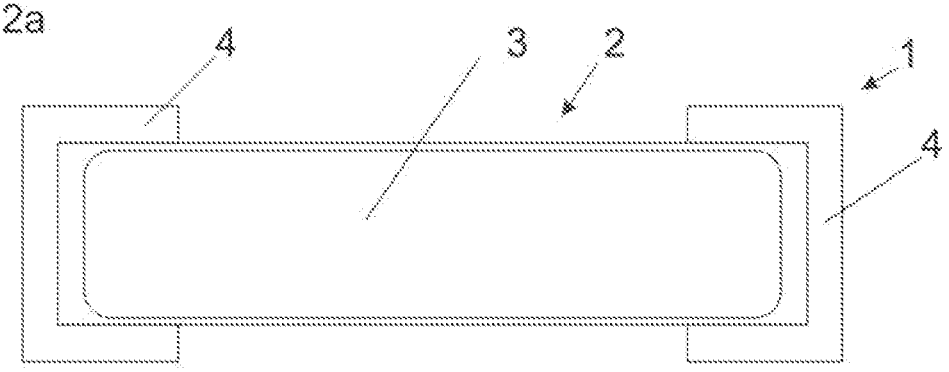
FIGS. 2*a* to 2*d* show steps in a method according to the invention of freezing a liquid.
Figure 2B:
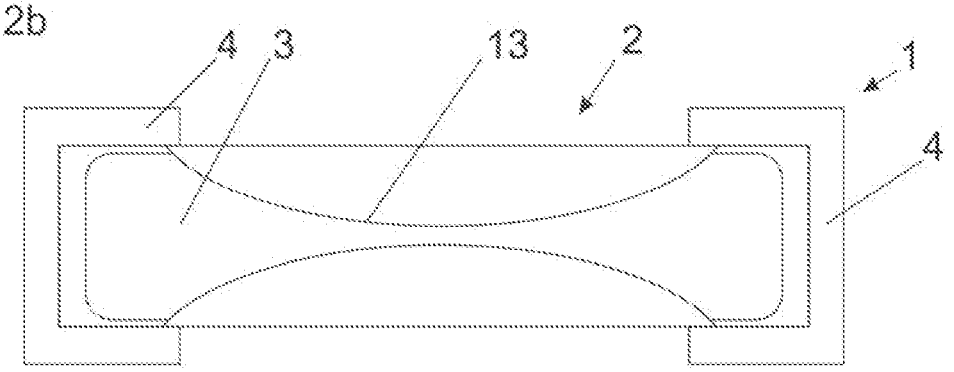

It can also be clearly seen from FIG. 2*b* that a relatively shallow cuboidal container can be advantageous because in that way the non-insulated region can freeze therethrough, before the further regions freeze to significant proportions.

Figure 2C:
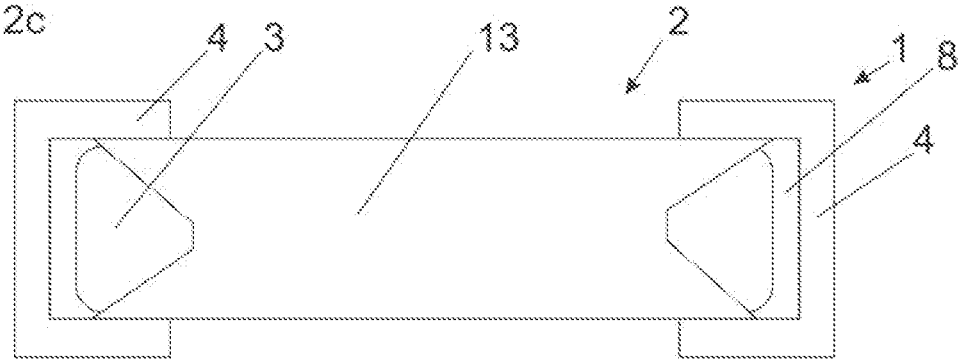

FIG. 2*c* shows further freezing of the liquid 3 after the "freezing fronts" of FIG. 2*b* have met and further freezing throughout the liquid slowly takes place to the sides. Here too there are no enclosed regions of unfrozen liquid 3.

FIG. 2*c* also shows a foam 8 which has a compensation function for the normal expansion in volume of the liquid 3 upon freezing.

Figure 2D:
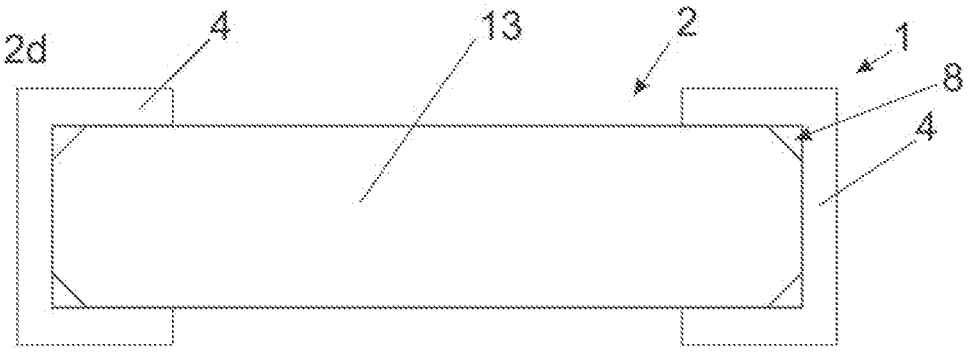

The compensation function will be clear in comparison with FIG. 2*d*. FIG. 2*d* shows the state of the arrangement 1, in which the liquid has completely frozen through, that is to say the frozen-through partial volume 13 almost completely fills out the container 2. The foam 8 has reduced its volume for compensation and can only still be seen in the corners of the view in FIG. 2*d*.

It will be clear from the comparison of FIGS. 1*a* to 1*c* on the one hand and FIGS. 2*a* to 2*d* on the other hand how an insulation, in particular insulation bodies 4, can prevent damage due to the expansion in volume of the liquid upon freezing.

Figure 3A:
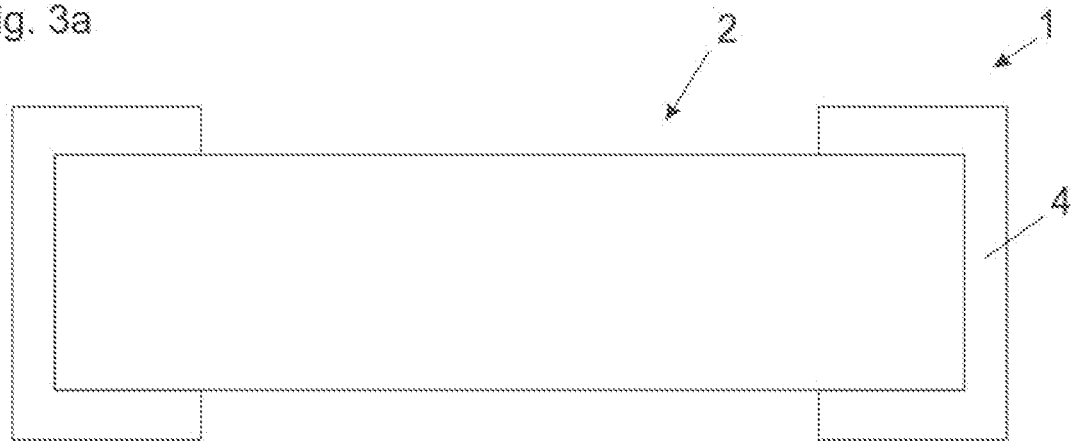
FIGS. 3*a* and 3*b* show diagrammatic views of an arrangement according to the invention.
Figure 3B:
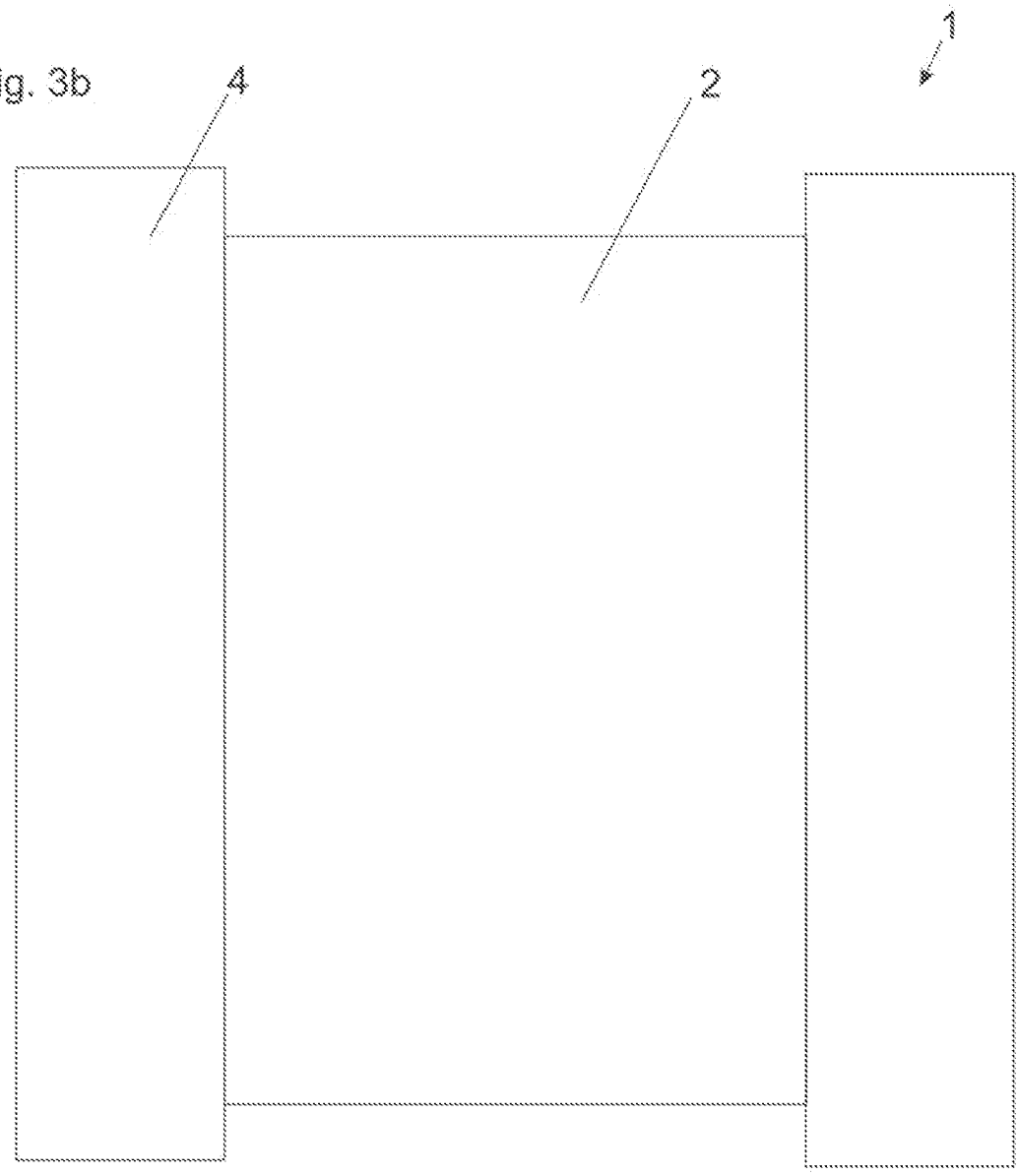

FIGS. 3*a* and 3*b* show diagrammatic views of the arrangement 1 according to the invention. That would again be FIG. 3*a* showing a side view. Besides the container 2 it is also possible to see the two U-shaped insulation bodies 4.

FIG. 3*b* shows a plan view of the same structure.

Figure 4:
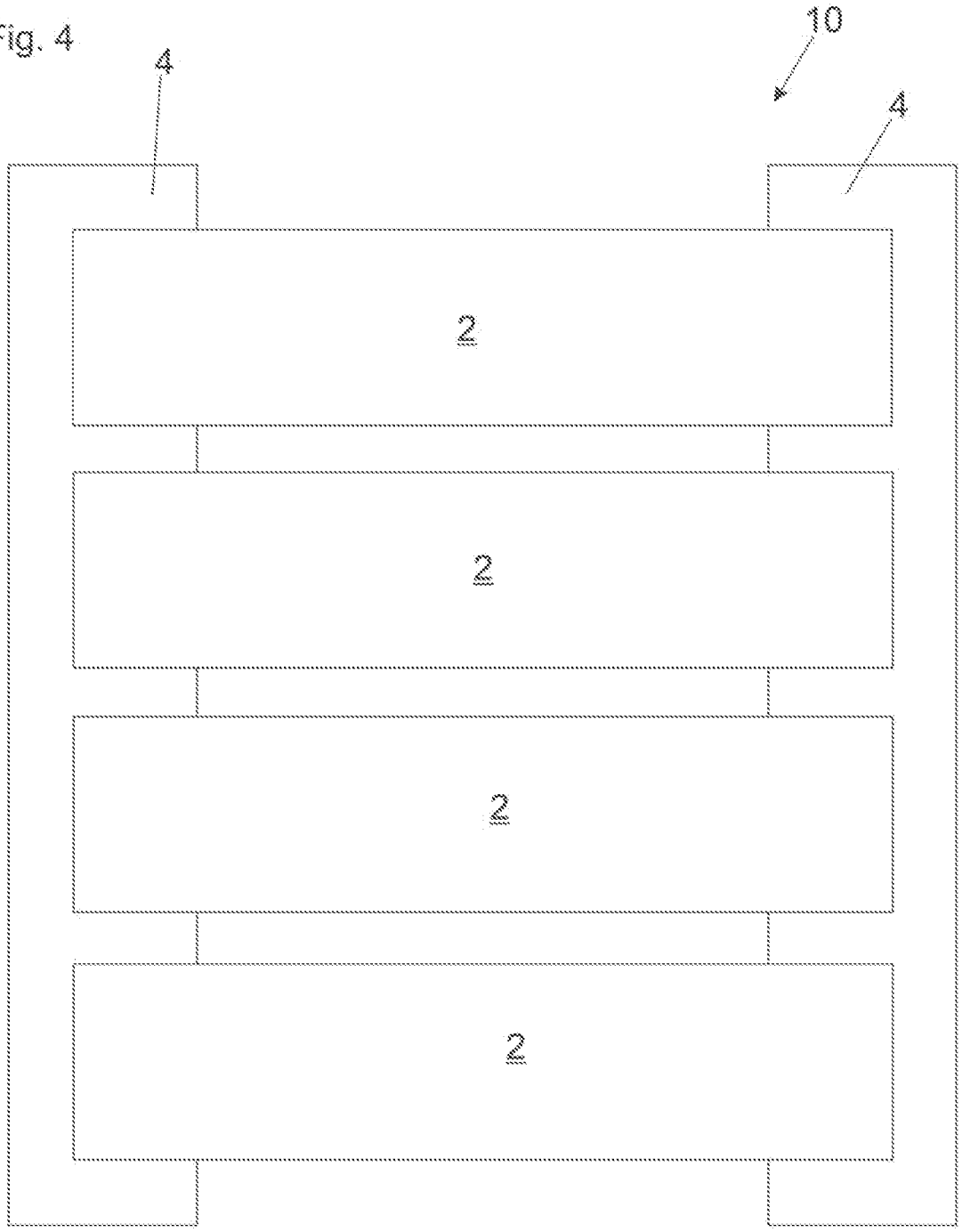
FIG. 4 shows a diagrammatic view of an arrangement according to the invention with a plurality of containers.

FIG. 4 shows an arrangement 10 comprising a plurality of mutually superposed containers 2 which are respectively provided with insulation bodies 4. In this case, each of the insulation bodies 4 has such a configuration that each insulation body 4 respectively accommodates a plurality of the containers 2. The containers 2 can thus, for example, also be really easily transported. Naturally, they can also be arranged completely as an arrangement 10 in a freezing apparatus 7 (see FIGS. 6*a* and 6*b*) and frozen in a single freezing process.

Figure 5A:
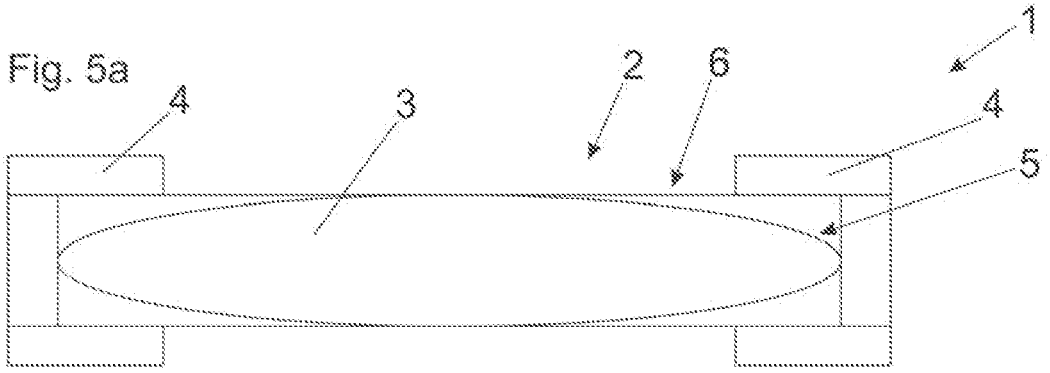
FIG. 5*a* shows a further but more detailed view of an arrangement according to the invention.

FIG. 5*a* shows a more detailed sectional view of the arrangement 1, wherein the container 2 is made up of an inner container 5 and an outer container 6. That inner structure of the container 2 can also be used in the other illustrated embodiments. The flexible inner container 5 holds the liquid 3 and the outer container 6 is mechanically stable. In addition, there is a certain excess volume between the inner container 5 and the outer container 6 that can also be filled with a foam 8.

Figure 5B:
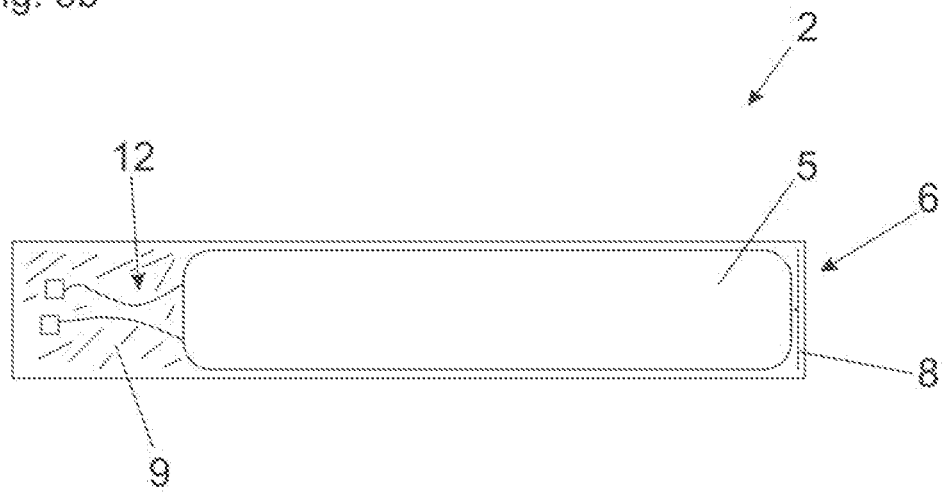
FIGS. 5*b* and 5*c* show views of an arrangement comprising an inner container and an outer container using a foam.
Figure 5C:
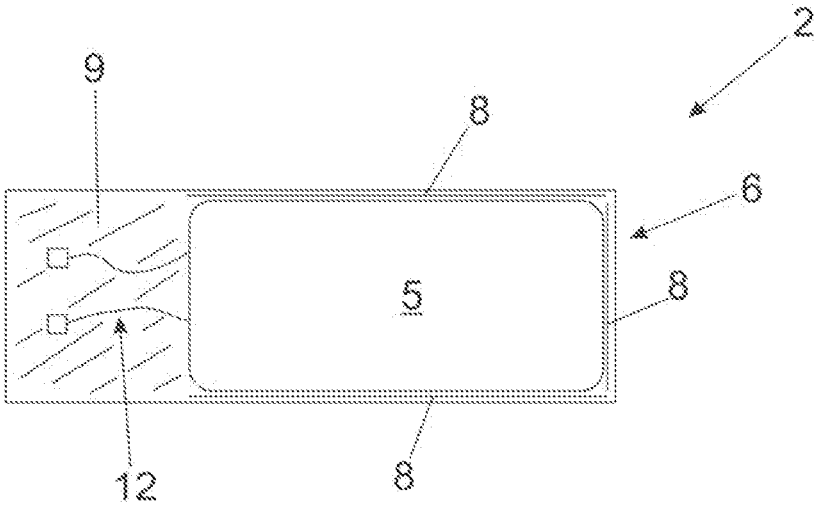

FIGS. 5*b* and 5*c* show an example of an arrangement of a rigid outer container 6 and a flexible inner container 5 (single use bag) using a foam 8. The foam 8 compensates for the expansion in volume of the liquid 3 upon freezing. In addition, the foam 8 can be of such a nature that it also sets at low temperatures so that after freezing, the inner container 5 is enclosed in a close fit in the foam 8 and in the outer container 6.

The foam 8 includes a foam block 9, by means of which attachments 12 like tubes and connecting elements can also be enclosed. The foam block 9 naturally also serves to compensate for the expansion in volume upon freezing of the liquid 3.

The outer container 6 can comprise plastic and/or metal. In the present embodiment, the cover layers are respectively made from (relatively thin) stainless steel and the side walls from a polyethylene.

For example, so-called visco-elastic foam 8 can be used as the foam 8, which hardens at certain negative temperatures.

Figure 6A:
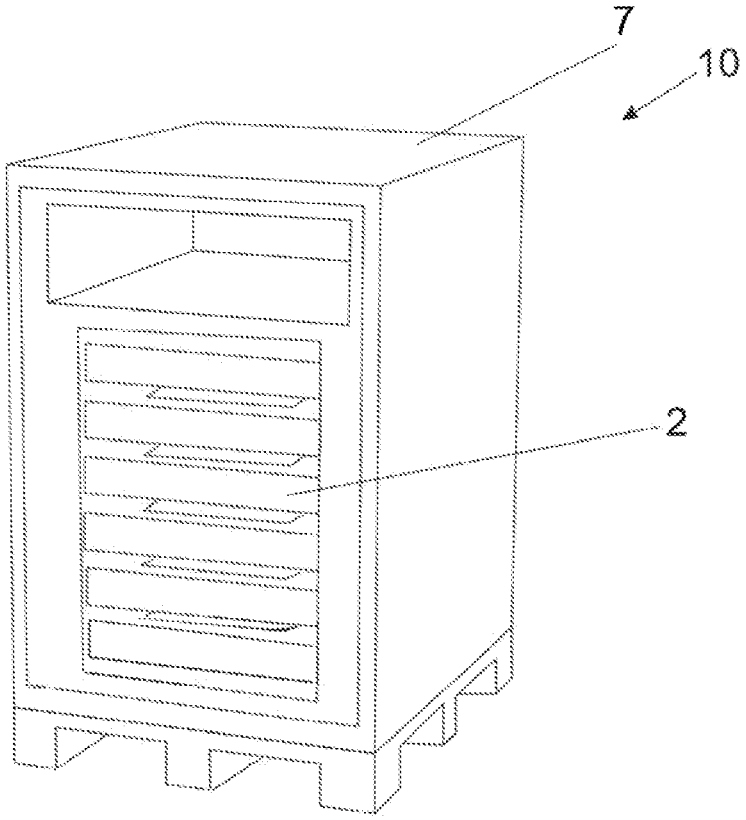
FIGS. 6*a* and 6*b* show views of an arrangement according to the invention with a plurality of mutually superposed containers.
Figure 6B:
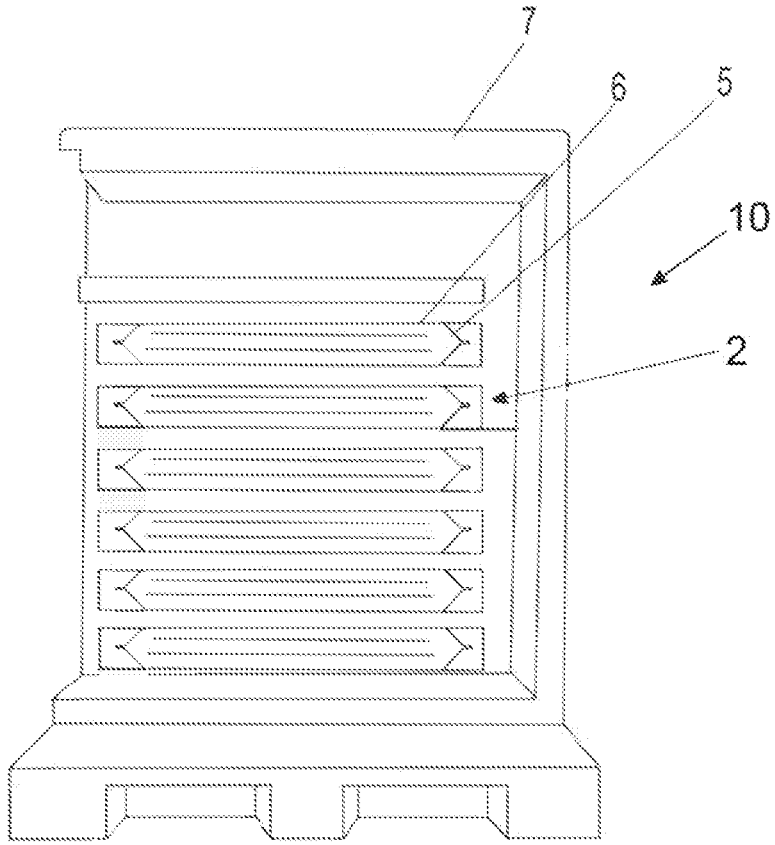

FIGS. 6*a* and 6*b* are a perspective and a sectional view of an arrangement 10 according to the invention with a plurality of containers 2 arranged in mutually superposed relationship within a freezing apparatus 7. FIG. 6*b* also indicates how the containers 2 also have an internal structure comprising an inner container 5 and an outer container 6. (Not all containers 2 are denoted by reference numerals in order not to make the views less clear).

Figure 7A:
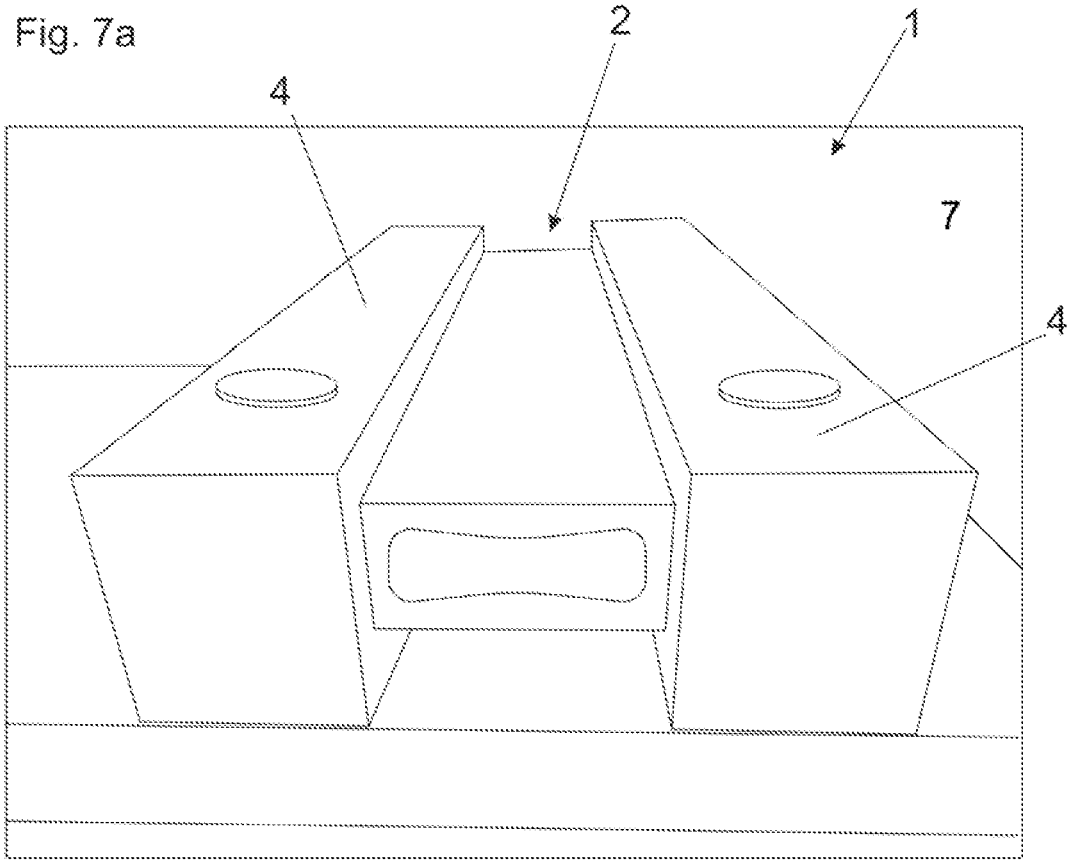
FIGS. 7*a* and 7*b* show photographs of the arrangement according to the invention.

To illustrate the real aspects, FIG. 7*a* shows an arrangement according to the invention in a freezing apparatus 7 after it was cooled to −85° Celsius. It can be clearly seen that the container 2 has not experienced any outward buckling, and therefore it can be assumed that a desired freezing of the liquid 3 therethrough has occurred, that is to say the liquid 3 was frozen without damage (to the surrounding items of equipment).

Figure 7B:
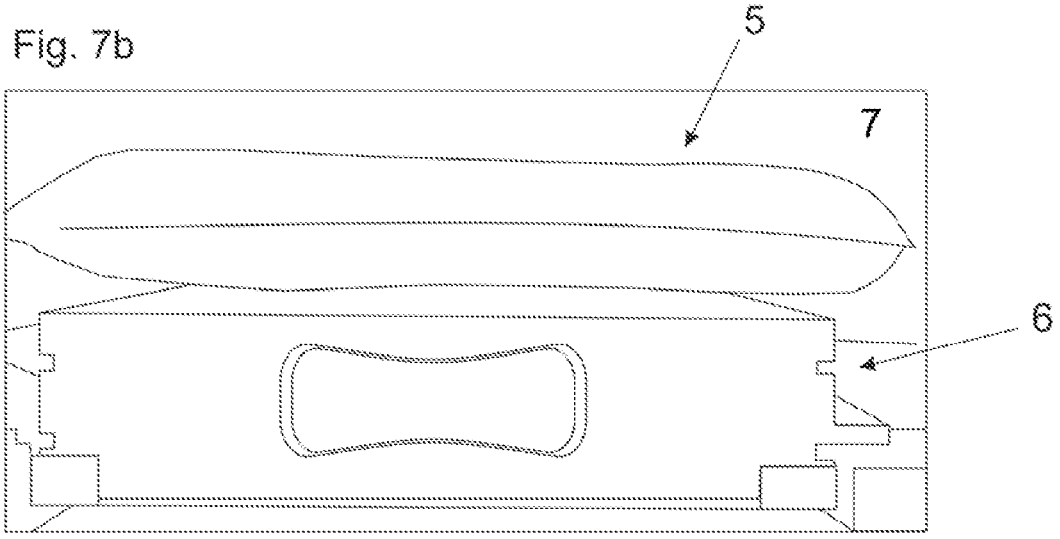

FIG. 7*b* shows how the inner container 5 looks after it has been removed from the outer container 6 in the frozen state. It can also be seen here that there are no major deformations.

The invention claimed is:

1. A method of freezing a liquid drug disposed in a container, the method comprising:

cooling the container for freezing the liquid drug;

insulating the container at a surface of a first volume portion of the container by fitting an insulation body on the surface of the first volume portion in a lateral direction; and cooling the container by applying a cooling element at a surface of a second volume portion of the container, the second volume portion being located at a center of the container and the first volume portion extending from the center of the container to the edges of the container;

wherein the container is cooled so that the liquid drug freezes therethrough in the first volume portion later than in the second volume portion.

2. The method according to claim 1, wherein the container has a cuboidal shape, and a height of the cuboidal container is less than a quarter of at least one of (i) a width and (ii) a length of the cuboidal container.

3. The method according to claim 1, wherein the insulation body has a U-shaped cross-section.

4. The method according to claim 1, wherein the container includes a flexible inner container holding the liquid drug and a rigid outer container.

5. The method according to claim 4, wherein the container includes a foam between the inner container and the outer container, the foam being configured to compensate for an expansion in the volume of the liquid drug upon freezing.

6. The method according to claim 5, wherein the foam has a decreasing elasticity with decreasing temperature below the freezing point.

7. The method according to claim 5, wherein the foam is configured to harden at a temperature between 0° C. to −30° C.

8. The method according to claim 7, wherein the foam is configured to harden at a temperature between −10° C. and −20° C.

9. The method according to claim 5, wherein the foam is configured to harden, and is configured so that a process of hardening is reversible.

10. The method according to claim 5, wherein the outer container is lined with the foam such that the inner container is completely surrounded by the foam when the inner container is arranged in the outer container.

11. The method according to claim 10, wherein the foam comprises a foam block in the outer container for receiving attachments.

12. The method according to claim 5, further comprising supplying an additional layer of foam in the outer container when the inner container is filled only partially to capacity.

13. The method according to claim 5, wherein the foam is an elastic foam to completely compensate for an expansion in the volume of the liquid drug upon freezing.

14. The method according to claim 1, wherein the container includes a top side and an underside formed of a metal plate.

15. A method of freezing liquid drugs in a plurality of containers, the method comprising freezing the liquid drugs in the containers at the same time in a mutually superposed relationship in a freezing apparatus, the freezing of the liquid drug in each of the containers being performed according to the method of claim 1.

16. An arrangement for carrying out the method according to claim 1, the arrangement comprising:

the container filled with the liquid drug, and the insulation body arranged at the surface of the first volume portion of the container, wherein the surface of the second volume portion of the container is insulation-free.

17. A freezing apparatus comprising:

one or more arrangements, each of the one or more arrangements being configured according to claim 16, the one or more arrangements being arranged within a freezing apparatus in mutually superposed relationship, the freezing apparatus being adapted to freeze the liquid drug within the container.

18. The method according to claim 1, wherein the cooling element is a cold gas, the container being exposed to the cold gas such that the cold gas flows around the liquid drug.

* * * * *